United States Patent [19]

Durland et al.

[11] 4,078,719

[45] Mar. 14, 1978

[54] EDDY CURRENT BRAKE FOR AIR DRIVEN CENTRIFUGE

[75] Inventors: Douglas Howard Durland, Palo Alto; George Norton Hein, Jr., San Carlos; Robert James Ehret, Los Altos, all of Calif.

[73] Assignee: Beckman Instruments, Inc., Fullerton, Calif.

[21] Appl. No.: 681,302

[22] Filed: Apr. 29, 1976

[51] Int. Cl.[2] ..... B04B 9/00

[52] U.S. Cl. ..... 233/23 R; 210/72; 188/164; 310/105

[58] Field of Search ..... 233/1 R, 1 B, 23 R, 233/23 A, 24; 210/72, 146; 74/5.43, 5.46; 188/164; 415/123; 310/105

[56] References Cited

U.S. PATENT DOCUMENTS

| | | | |
|---|---|---|---|
| 2,106,609 | 1/1938 | Krauss | 210/72 |
| 3,064,149 | 11/1962 | Baermann | 310/105 X |
| 3,447,006 | 5/1969 | Bair | 310/105 X |
| 3,958,753 | 5/1976 | Durland et al. | 233/23 R |

*Primary Examiner*—George H. Krizmanich

*Attorney, Agent, or Firm*—Robert J. Steinmeyer; Ferd L. Mehlhoff

[57] ABSTRACT

An improved apparatus and method for braking the rotation of a centrifuge rotor is disclosed comprising magnet means operable in a first condition wherein substantially no eddy currents are induced in a rotating rotor made of electrically conductive material by the magnetic flux of the magnet means and a second condition wherein eddy currents are induced into the rotating rotor sufficiently to slow the rotor. In one embodiment, magnet means is movable from a first position wherein substantially no eddy currents are induced in an electrically conductive portion of the rotating rotor by the magnetic flux to a second position wherein eddy currents are induced into the rotating rotor in a quantity sufficient to slow the rotor. In an alternate embodiment, the magnet means is an electromagnet connected to an interruptible source of power so that, when power is applied, eddy currents are developed in the rotor sufficient to brake the rotation thereof, and, when power is disconnected, the braking eddy current force is immediately discontinued.

11 Claims, 4 Drawing Figures

EDDY CURRENT BRAKE FOR AIR DRIVEN CENTRIFUGE

BACKGROUND OF THE INVENTION

The present invention relates to centrifuges and more particularly to an improved method and apparatus for braking the rotation of a centrifuge.

In a centrifuge, the problem of decelerating or braking has always been a major factor. A braking device must perform its braking function quickly without causing a remixing of the separated components through undesired vibration and oscillation. Such factors as the mass of the device to be stopped and the speed at which it is traveling have significant effect.

In air driven centrifuges, the braking function is a much more complex problem than in spindle driven centrifuges. An air driven centrifuge, such as illustrated in U.S. Pat. No. 3,456,875 issued to George N. Hein, includes a rotor chamber having a rotor seat and a rotor having a plurality of turbine fins formed on the under side. The rotor seat includes driving air jet means for impinging pressurized air stream against the turbine flutes of the rotor for supporting and spinning the rotor on an air cushion above the rotor seat. In addition, support air jet means may also be provided within the seat for directing pressurized air streams against the under side of the rotor to support the rotor when the driving air jet streams are inactivated. Such an arrangement is disclosed in an application entitled Air Levitation For Air Driven Centrifuge filed concurrently herewith in the name of George N. Hein. When supported and spinning on the air bearing thus formed, the rotor is operating in a virtually frictionless environment.

Because air driven centrifuge rotors are supported on this substantially friction-free cushion of air, it is difficult to design a system employing air braking streams that will make the rotor come to a gradual, complete stop. While great pains in design can be taken to hold any rotational effect due to a supporting air stream to a minimum, it is difficult to completely eliminate any rotational effect. There is always a certain amount of windmilling while the supporting or holding air stream moves across the turbine flutes of such a rotor. In addition, the design of the rotor, or the loading of the sample therein, always introduces certain parameters which create critical speeds at which the rotor will precess, wobble, or vibrate excessively while decelerating. Any unbalanced force applied to the rotor for braking purposes can cause the rotor to move out of its rotational axis where it may come into contact with the sidewalls of its seat and thrash about within the centrifuge chamber.

SUMMARY OF THE INVENTION

Thus, the present invention is directed to an apparatus and method for providing a rapid and equally balanced deceleration force for such a centrifuge.

This is accomplished by making the rotor, or a portion of the rotor, of an electrically conductive material. A magnet means is provided which can be made to produce a magnetic flux field in which the rotor's electrically conductive material may rotate. An electrically conductive material rotating in a field of magnetic flux will have edge currents induced in the electrically conductive material. The flux density of the magnetic field can be made large enough to cause a braking effect on the rotating electrically conductive material through these eddy currents. The magnet means of the present invention is sized to be capable of causing such a braking effect in the rotating rotor. When the centrifuge is running and no braking effect is desired, the magnetic flux field is removed to a point where no braking effect will be created. This can be accomplished by physically moving the magnet means or, if an electromagnet is used, by removing power from the magnet. When braking is desired, the magnet means is physically moved, or alternatively the power is connected with an electromagnet, where the magnetic flux field will cause the desired braking effect.

DESCRIPTION OF THE PREFERRED EMBODIMENT

Figure 1:
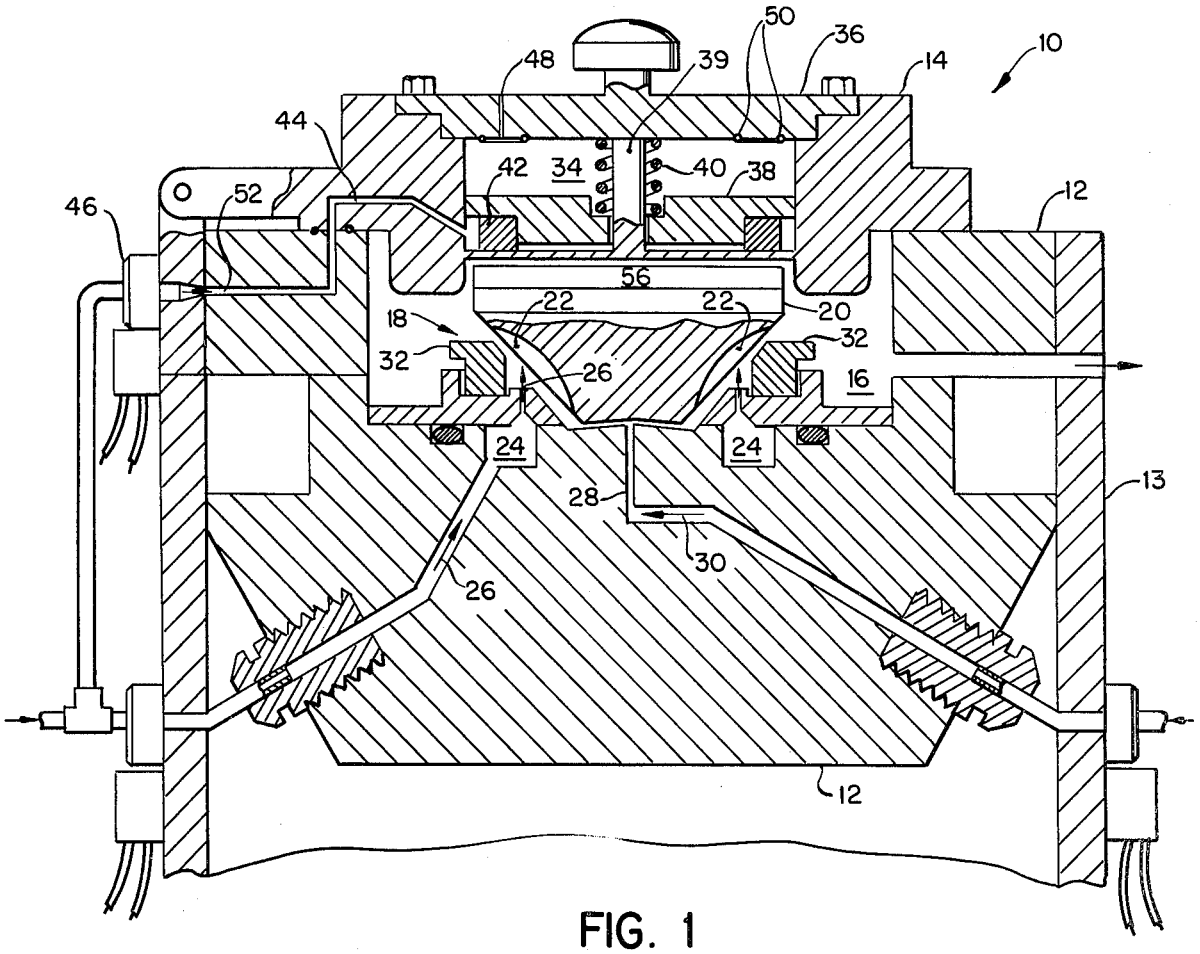
FIG. 1 is a sectional elevation view through an air driven centrifuge employing the preferred embodiment of the present invention.
Figure 2:
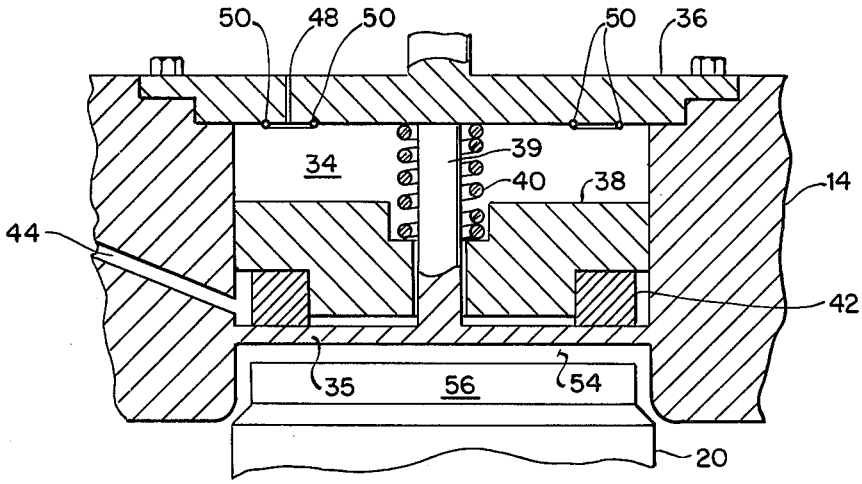
FIG. 2 is an expanded view of the present invention as embodied in the centrifuge of FIG. 1.

Referring to FIG. 1 and FIG. 2, a centrifuge assembly 10 employing a preferred embodiment of the present invention is disclosed. Centrifuge assembly 10 comprises a base 12, supported in an outer housing 13, and a lid 14. With lid 14 in its closed position on base 12 as shown, a rotor chamber 16 is formed having a rotor seat 18 in the bottom thereof. A rotor 20 is designed to fit within rotor chamber 16 as shown. The rotor 20 has a plurality of turbine flutes 22 formed on the under side thereof. The rotor seat 18 includes driving air jet means 24 for impinging pressurized driving air streams 26 against the turbine flutes 22 of the rotor 20 for supporting and spinning the rotor 20 on an air cushion above the rotor seat 18. Support air jet means 28 are also provided in the rotor seat 18. They direct a supporting air stream 30 under pressure against the under side of the rotor 20 for supporting the rotor 20. A support pad or stator 32 is provided in rotor seat 18 for supporting rotor 20 when it is at rest.

The braking apparatus is, in its preferred embodiment as set forth in FIGS. 1 and 2, located in the lid 14. Lid 14 contains a magnet chamber 34 covered by removable cap 36. A nonmagnetic carrier 38 is disposed within the magnet chamber 34. Nonmagnetic carrier 38 is movable vertically within magnet chamber 34, being guided by the inner walls of chamber 34 and guide post 39. Additionally, it is biased adjacent the bottom of magnetic chamber 34 by spring means 40, and has a magnet or a plurality of magnets 42 attached thereto. An energizing air passage 44 communicates with the under side of nonmagnetic carrier 38, as shown, and is attached to a supply of pressurized air through valve means 46. Removable cap 36 contains an air escape passage 48 fitted with O-ring seals 50 as shown.

When valve means 46 is opened, brake release air 52 flows through energizing air passage 44 into magnetic chamber 34 on the under side of nonmagnetic carrier 38. The brake release air 52 lifts nonmagnetic carrier 38 along guide post 39 against the bias of spring means 40. The air in magnet chamber 34 above nonmagnetic carrier 38 escapes through air escape passage 48 as nonmagnetic carrier 38 rises. When the top of nonmagnetic carrier 38 reaches removable cap 36 it seats against O-ring seals 50 and prevents the further escape of air through air escape passage 48. Nonmagnetic carrier 38 then remains in this raised position as long as valve means 46 are open. When valve means 46 is closed, the flow of brake release air 52 is interrupted. Nonmagnetic carrier 38 is then forced by spring means 40 back against the bottom of magnet chamber 34 in the position shown in FIG. 1. In the descended or braking position shown in FIG. 1, with valve means 46 closed, the magnets 42 are in close proximity to rotor 20, being separated only by the thickness of bottom wall 35 of lid 14 forming the bottom of magnetic chamber 34 and by the air gap between bottom wall 35 and rotor 20. The bottom wall 35 of magnet chamber 34 is of a material and thickness such that when magnets 42 are close adjacent bottom wall 35, the required magnetic flux can pass therethrough.

The operating sequence of an air driven centrifuge employing the present invention is as follows. When it is desired to operate the rotor 20 at high speed, the magnet is removed from the vicinity of the rotor 20. This is accomplished, as described above, by opening valve means 46 which allows brake release air stream 52 to force the magnet 42 and nonmagnetic carrier 38 up against the force of spring means 40 until the top of nonmagnetic carrier 38 contacts the seals 50 in cap 36. Normal operation of rotor 20 by the driving air streams 26 can then be accomplished. At termination of the centrifuge run, it is desired to rapidly reduce the speed of the rotor 20, while supporting it on air. One way this can be accomplished is by supporting rotor 20 with air stream 30 and stopping the flow of driving air stream 26. When valve means 46 is closed, spring means 40 forces nonmagnetic carrier 38 and magnet 42 down. Leakage around the side of nonmagnetic carrier 38 allows air in the lower portion of magnet chamber 34 to vent to the upper portion of chamber 34.

The lid 56 of rotor 20 is normally made of aluminum or other electrically conductive material. Thus, with the magnet 42 closely adjacent lid 56, strong eddy currents are generated in the lid due to this rotating member cutting the magnetic flux lines of magnet 42. The eddy currents dissipate the rotor kinetic energy as heat in the rotor lid 56, and cause the rotor 20 to rapidly reduce in rotational speed. The force applied to the rotor by the eddy currents is very uniform so that the rotor remains in its operating axis during deceleration. As an example, it has been found that, by employing the present invention, a rotor weighing 30 grams and rotating at 100,000 r.p.m. can be reduced to a speed of between 100 to 100 r.p.m. in 8 to 12 seconds.

Figure 3:
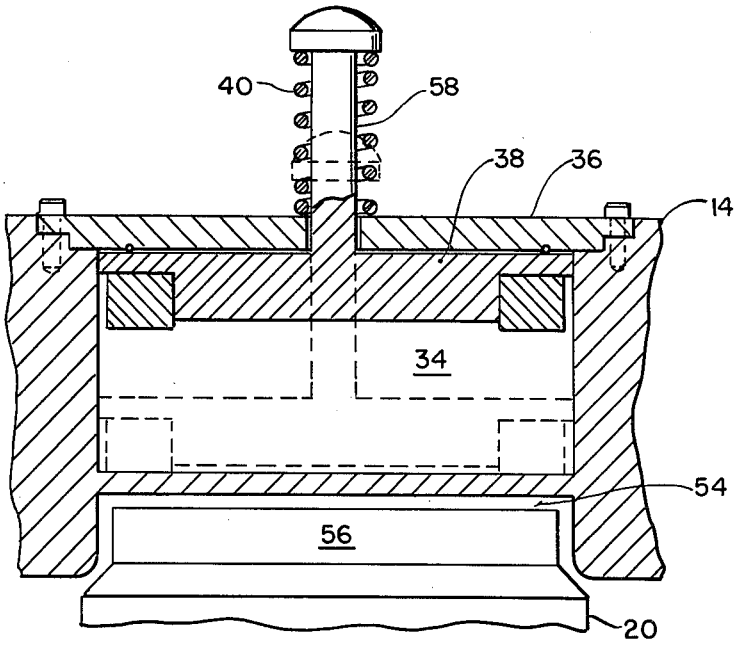
FIG. 3 is a sectional elevation view of an alternate embodiment of the present invention.

It is to be understood that the embodiment, as shown, is only one configuration and that the novelty of the present invention lies in braking an air driven centrifuge rotor by converting a magnet means (which could be a permanent or electromagnet) from a condition where substantially no eddy currents are induced in an electrically conductive portion of the rotating rotor by the magnetic flux of the magnet means to a condition where eddy currents are induced sufficient to slow the rotor. Thus, while the preferred embodiment of FIGS. 1 and 2 shows the use of a magnet moved to two different positions by air pressure apparatus, the magnet could be moved manually, as shown in FIG. 3. In FIG. 3, the nonmagnetic carrier 38 includes an actuator portion 58 and spring means 40 and is moved by spring 40 to a position within the chamber 34, as shown, so as to normally bias the magnet 42 away from the bottom of rotor lid 56. The nonmagnet carrier 38 remains in the position shown in FIG. 3 during the operation of the rotor 20. When braking is desired, actuator 58 is then depressed by hand to the ghost position of FIG. 3 to rapidly reduce the speed of the rotor 20.

Figure 4:
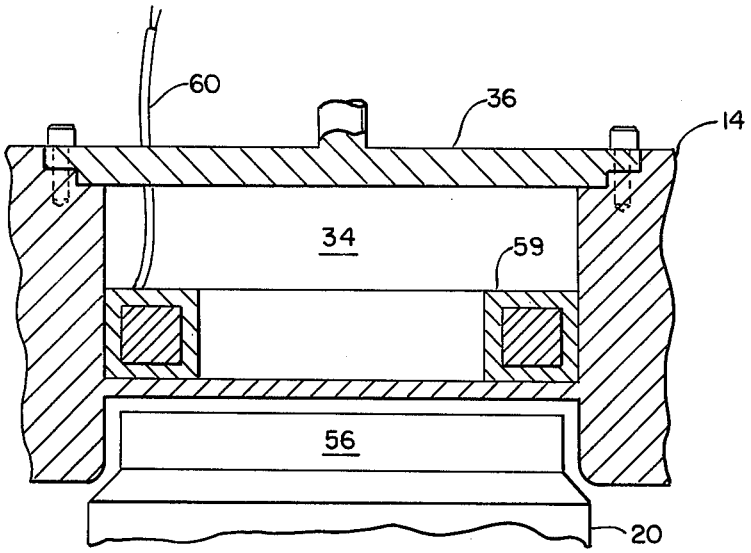
FIG. 4 is a sectional elevation view of another embodiment of the present invention employing an electromagnet.

In another embodiment, shown in FIG. 4, an electromagnet 59 is mounted in the same position as the permanent magnet of FIGS. 1 and 2 and connected to an interruptible source of power (not shown) through connector 60. The magnet is not physically moved between a run and brake position to change conditions, but rather, the power is interrupted from electromagnet 59 to allow the rotor 20 to freely rotate. On application of power to electromagnet 59, eddy currents rapidly reduce the rotor speed.

In a similar fashion, the present invention could be used when positioned other than as shown, and with rotors of various shapes and materials. It is only required that the rotor have an electrically conductive portion such as a lid, insert in the lid, band or ring about the body, or such, sufficient to develop eddy currents capable of stopping the rotor. The magnet means, whether mounted above, to the side, or below, need only be capable of assuming one condition wherein it passes magnetic flux through the electrically conductive portion of the rotating rotor in an amount sufficient to develop the required eddy currents when it is desired to brake the rotor and another condition wherein it does not.

Having thus described our invention, we claim:

1. In an air driven centrifuge having a rotor at least a portion of which is formed of an electrically conductive material and means for rotating the rotor on a supporting cushion of pressurized air about an axis, an improved method of braking the rotor when rotating comprising the step of:

converting magnet means from a first condition wherein substantially no eddy currents are induced in the electrically conductive portion of the rotating rotor by the magnetic flux of the magnet means to a second condition wherein eddy currents are induced into said electrically conductive portion of the rotating rotor thereby producing a braking effect to rapidly reduce the rotation of the rotor.

2. The method of claim 1 wherein the magnet means comprise a source of constant magnetic flux and said means for converting of said magnet means between said first and second conditions is accomplished by physically moving said magnet means from a first position to a second position.

3. The method of claim 1 wherein the magnet means is an electromagnet and said means for converting said magnet means from said first and second conditions is accomplished by supplying electric power to and interrupting said supply of electric power to said electromagnet.

4. The method of claim 2 wherein:

a. said magnet means is biased to said first position and has means for applying manual pressure thereto; and, b. said moving of said magnet means from said first position to said second position is accomplished by applying a manual force to said means for applying manual pressure, said force being sufficient to overcome said bias.

5. In an air driven centrifuge having a rotor at least a portion of which is formed of an electrically conductive material, means for supporting the rotor on a cushion of pressurized air about an axis and means for rotating the rotor about the axis, improved apparatus for braking the rotor when it is rotating comprising:

a. magnet means being convertible from a first condition wherein substantially no eddy currents are induced in said electrically conductive portion of the rotating rotor by the magnetic flux of said magnet means to a second condition wherein eddy currents are induced into said electrically conductive portion of the rotating rotor in a quantity sufficient to slow the rotor; and, b. means for converting said magnet means from one of said conditions to the other of said conditions.

6. The apparatus of claim 5 wherein:

a. said magnet means are movable from a first position wherein substantially no eddy currents are induced in said electrically conductive portion of the rotating rotor by the magnetic flux of said magnet means to a second position wherein eddy currents are induced into said electrically conductive portion of the rotating rotor in a quantity sufficient to slow the rotor; and, b. said means for converting comprise means for moving said magnet means from one of said positions to the other of said positions.

7. The apparatus of claim 6 and additionally: means for biasing said magnet means in said first position cooperating with said magnet means.

8. The apparatus of claim 6 and additionally: means for biasing said magnet means in said second position cooperating with said magnet means.

9. The apparatus of claim 5 wherein:

a. said magnet means is an electromagnet; and, b. said means for converting comprise means for supplying electric power to and removing said power from said electromagnet.

10. In an air driven centrifuge having a rotor at least a portion of which is an electrically conductive material, air pressure means supporting the rotor on an air bearing, and air pressure means for rotating the air supported rotor about an axis, improved apparatus for braking the rotor when it is rotating comprising:

a. a lid having an enclosure therein having a wall thereof disposed adjacent the electrically conductive portion of the rotor when the rotor is rotating, said wall being of a thickness and material whereby magnetic flux can pass from said enclosure through said wall and induce eddy currents in the electrically conductive portion of the rotor sufficient to slow the rotor;

b. a nonmagnetic carrier disposed within said enclosure and adapted for movement therein between a first position not adjacent said wall and a second position adjacent said wall;

c. a magnet carried by said nonmagnetic carrier being of a magnetic strength whereby when said nonmagnetic carrier is in said first position the magnetic flux of said magnet will not pass through said wall in sufficient quantity to induce eddy currents in the electrically conductive portion of the rotor sufficient to brake the rotor and when said nonmagnetic carrier is in said second position the magnetic flux of said magnet will pass through said wall in sufficient quantity to induce eddy currents in the electrically conductive portion of the rotor sufficient to brake the rotor; and, d. means for moving said nonmagnetic carrier from one of said positions to the other.

11. Apparatus as claimed in claim 10 and additionally comprising:

a. spring means operably connected to said nonmagnetic carrier whereby said nonmagnetic carrier is biased to said first position; and, b. a handle connected to said nonmagnetic carrier passing through said lid and being adapted to move said nonmagnetic carrier between said positions from manual pressure.

* * * * *